US005769235A

United States Patent [19]

Keach et al.

[11] Patent Number: 5,769,235

[45] Date of Patent: Jun. 23, 1998

[54] PACKAGING DEVICE AND METHOD FOR ASSEMBLING SAME

[75] Inventors: Priscilla M. Keach; Dean F. Staal, both of Chicago, Ill.; Stephen J. Lang, Lawrence, Kans.; Randy L. Sperry, Burlington, Iowa

[73] Assignee: Ade, Inc., Chicago, Ill.

[21] Appl. No.: 666,015

[22] Filed: Jun. 19, 1996

[51] Int. Cl.[6] ..... B65D 81/02; B65D 85/30

[52] U.S. Cl. ..... 206/583; 206/592

[58] Field of Search ..... 206/521, 583, 206/591, 592, 594, 585

[56] References Cited

U.S. PATENT DOCUMENTS

| | | | |
|---|---|---|---|
| 2,501,570 | 3/1950 | Larson | 206/592 |
| 2,681,142 | 6/1954 | Cohen | 206/592 |
| 3,523,863 | 8/1970 | Juhos | 206/583 |
| 4,491,225 | 1/1985 | Baillod . | |
| 4,852,743 | 8/1989 | Ridgeway . | |
| 4,923,065 | 5/1990 | Ridgeway . | |
| 5,071,009 | 12/1991 | Ridgeway . | |
| 5,183,159 | 2/1993 | Hojnacki et al. . | |
| 5,287,968 | 2/1994 | Ridgeway . | |
| 5,388,701 | 2/1995 | Ridgeway . | |
| 5,405,000 | 4/1995 | Hagedon et al. | 206/583 |

FOREIGN PATENT DOCUMENTS

| | | | |
|---|---|---|---|
| 475299 | 11/1937 | United Kingdom | 206/583 |

*Primary Examiner*—David T. Fidei
*Attorney, Agent, or Firm*—Brinks Hofer Gilson & Lione

[57] ABSTRACT

A packaging device includes upper and lower container portions that support respective frames that, in turn, support respective support films. The frames and the container portions are configured such that the act of installing the frames in the container portions automatically increases tension in the films. This can be accomplished by rotating opposed portions of the frames in opposite directions, by displacing the film out of the plane in which it is originally supported by the frame, or by displacing opposed portions of the frame away from one another. The film of the lower container portion is recessed with respect to a peripheral lip of the lower container portion, while the film of the upper container portion protrudes beyond the peripheral lip of the upper container portion. In this way objects are prevented from rolling out of the lower container portion, yet the films are brought into face-to-face contact when the packaging device is closed.

17 Claims, 8 Drawing Sheets

10
14
20
12
24

24
22
10
40
32
28
14
16
20
40
16
30
20
28
22
12
26
26

Fig. 8
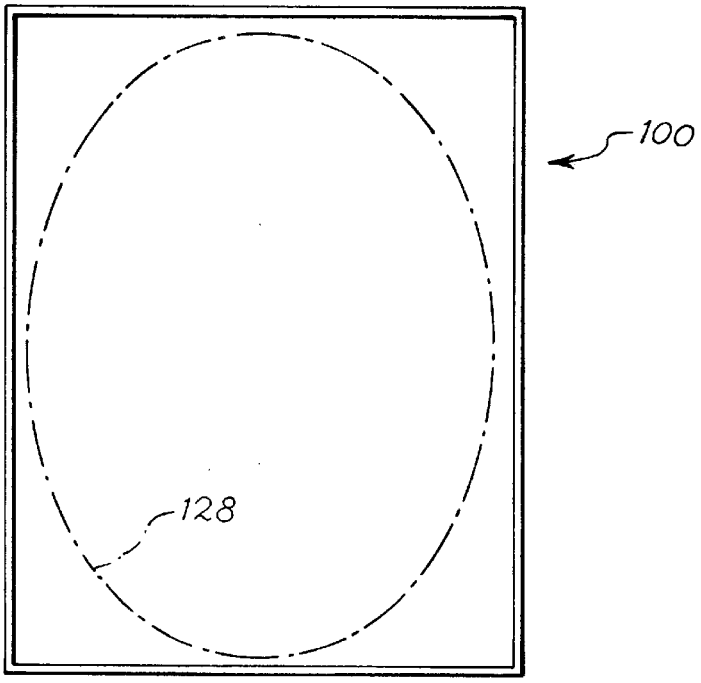
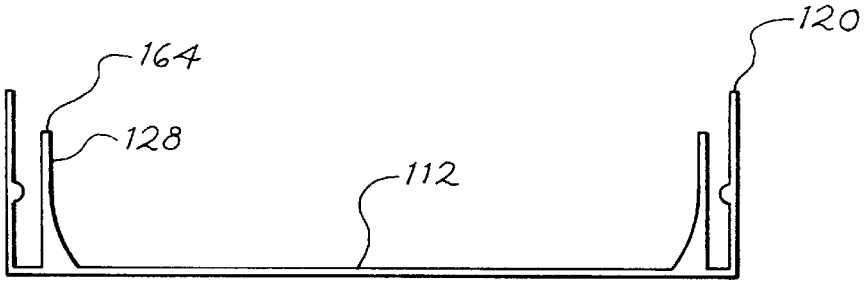
Fig. 9
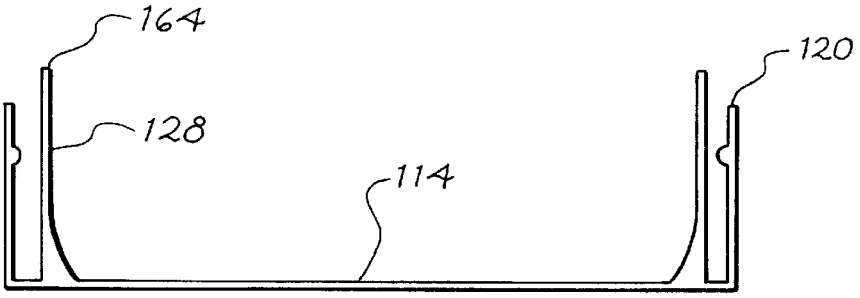
Fig. 10

Fig. 11
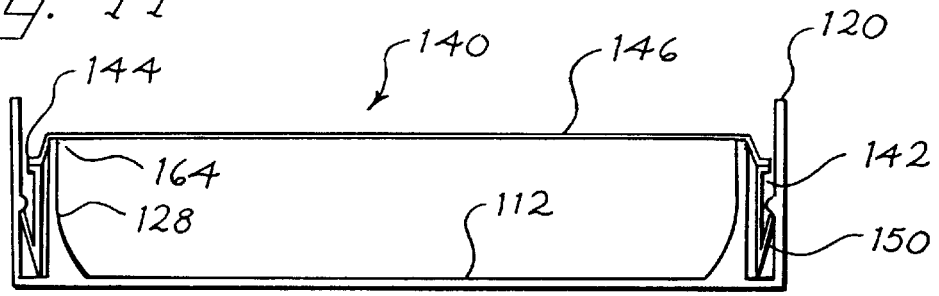
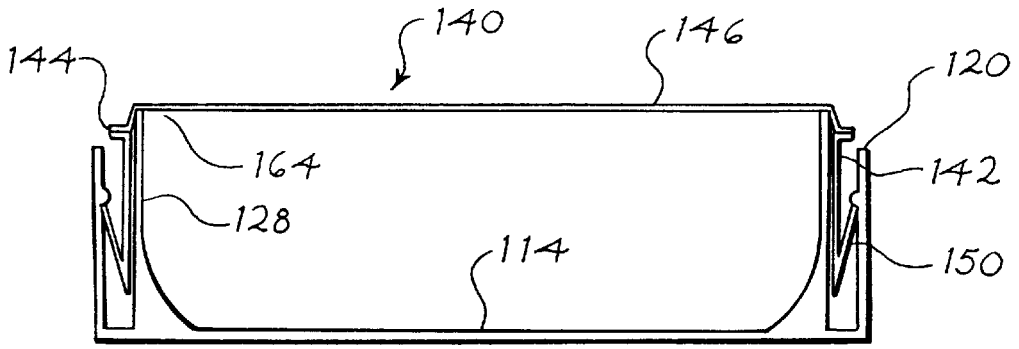
Fig. 12
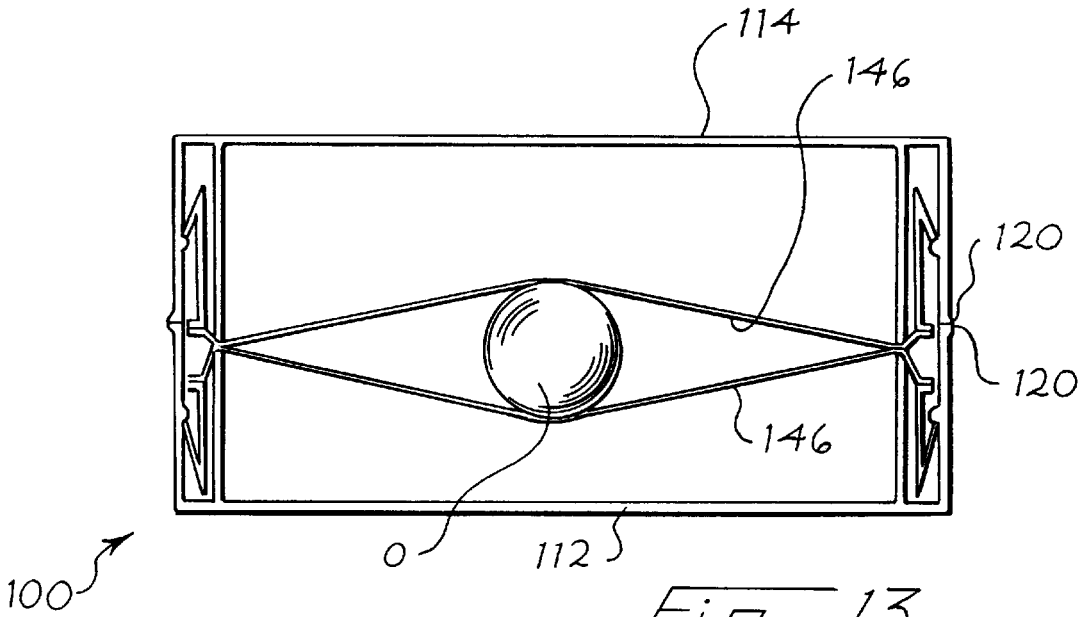
Fig. 13

PACKAGING DEVICE AND METHOD FOR ASSEMBLING SAME

BACKGROUND OF THE INVENTION

This invention relates to an improved packaging device of the type that provides two opposed support films that support the object being packaged away from the side walls of the packaging device.

Packaging devices of the type described above are known in the art, as for example, as disclosed in Baillod U.S. Pat. No. 4,491,225, Ridgeway U.S. Pat. No. 4,852,743, Hojnacki U.S. Pat. No. 5,183,159 and Phelps U.S. Pat. No. 4,903,827.

The Baillod patent describes a packaging device at column 7, lines 52 and following, in which a support film is first secured to a pair of retainers, preferably retainers have a means which permit them to be fastened together once joined. A shell can then be joined to each retainer, either before or after the retainers are fastened together. This arrangement provides important advantages, because it allows the support film and retainer to be removed from the shell if the film is damaged in use, thereby permitting reuse of the shell.

In spite of the apparent advantages of this arrangement, a problem exists with respect to the manner in which the film is fastened to the retainer. Typically, it is desired to tension the film, and one approach that has been used is to tension the film prior to the time it is secured to the retainer. This approach provides a properly tensioned film, but it substantially complicates the process by which the film is secured to the retainer.

It is an object of this invention to overcome this drawback of the art.

SUMMARY OF THE INVENTION

According to a first aspect of this invention, a packaging device is provided comprising first and second container portions. At least one support element is provided comprising a frame and a film secured to the frame. The support element is secured to the first container portion with at least a central portion of the film spaced from the first container portion. Means are provided for increasing tension on the film when the support element is secured in place to the first container portion.

According to a second aspect of this invention, a method is provided for assembling a packaging device. This method comprises the steps of providing an upper container portion and lower container portion, providing at least one support element having a frame and a support film secured to the frame, and then installing the support element in one of the container portions. The installing step comprises the step of increasing tension in the film between at least two opposed portions of the frame such that the film is stretched between the opposed portions of the frame more tightly after the installing step than before the installing step.

According to a third aspect of this invention, a packaging device is provided comprising first and second container portions, each comprising a respective peripheral lip. First and second films are provided, each secured to a respective one of the container portions. The first film is recessed with respect to the peripheral lip of the first container portion while the second film is situated above the peripheral lip of the second container portion. This arrangement allows the packaging device to function properly, while still providing a first film that is recessed with respect to the respective peripheral lip in order to reduce the likelihood that an object being packaged in the packaging device will roll off of the first film before the first and the second container portions are closed.

BRIEF DESCRIPTION OF THE DRAWINGS

FIG. 8 is a top view of a packaging device which incorporates a second preferred embodiment of this invention.

FIGS. 9 and 10 are cross-sectional views of the lower and upper container portions, respectively, of the container of FIG. 8, prior to installation of the respective frames and films.

FIGS. 11 and 12 are cross-sectional views corresponding to FIGS. 9 and 10, respectively, after installation of he respective frames and films.

FIG. 13 is a cross-sectional view of the fully assembled container of FIG. 8.

DETAILED DESCRIPTION OF THE PRESENTLY PREFERRED EMBODIMENTS

Figure 1:
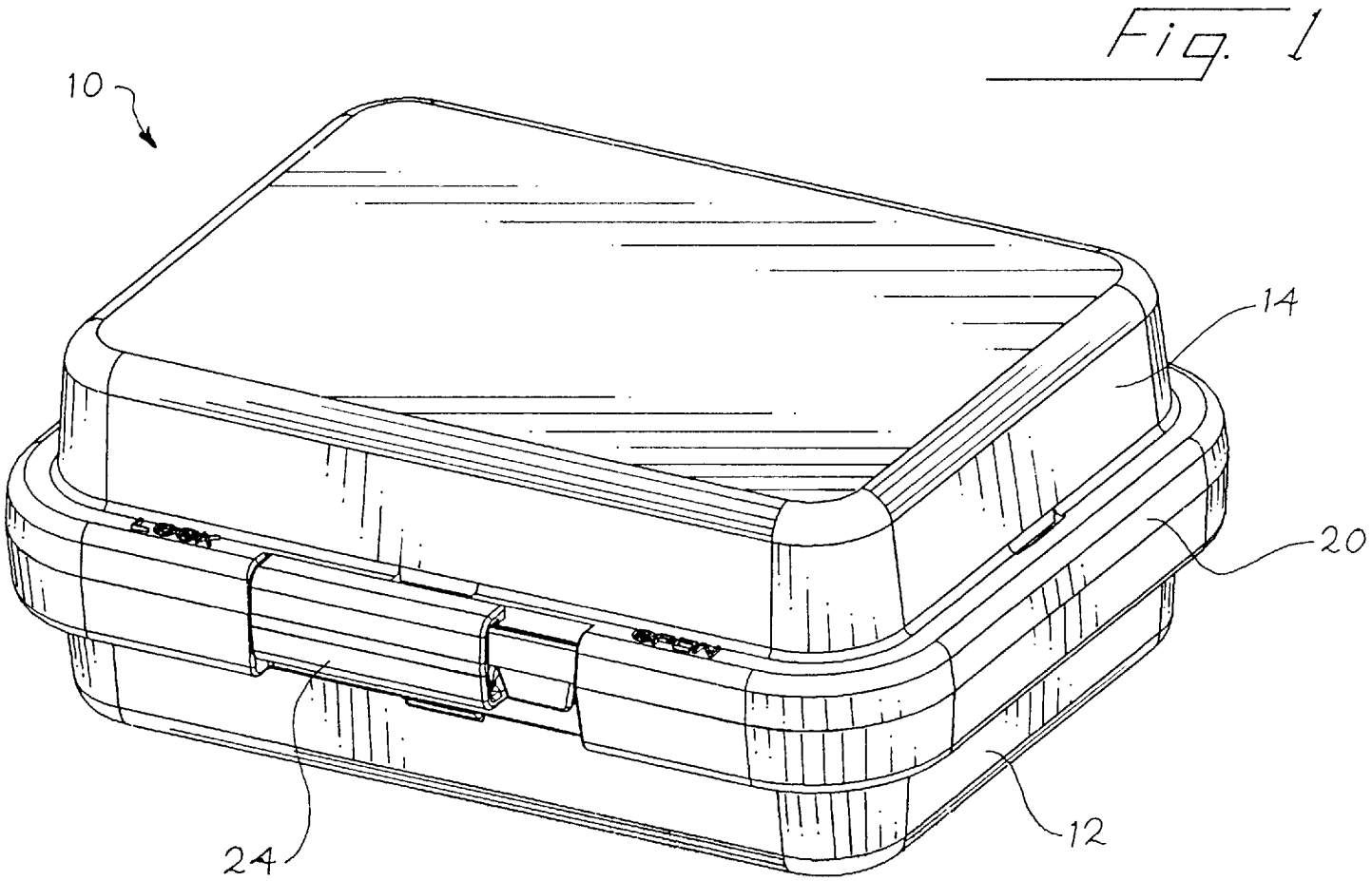
FIG. 1 is a perspective view of a packaging device which incorporates a first preferred embodiment of this invention, wherein the packaging device is shown in a fully closed configuration.
Figure 2:
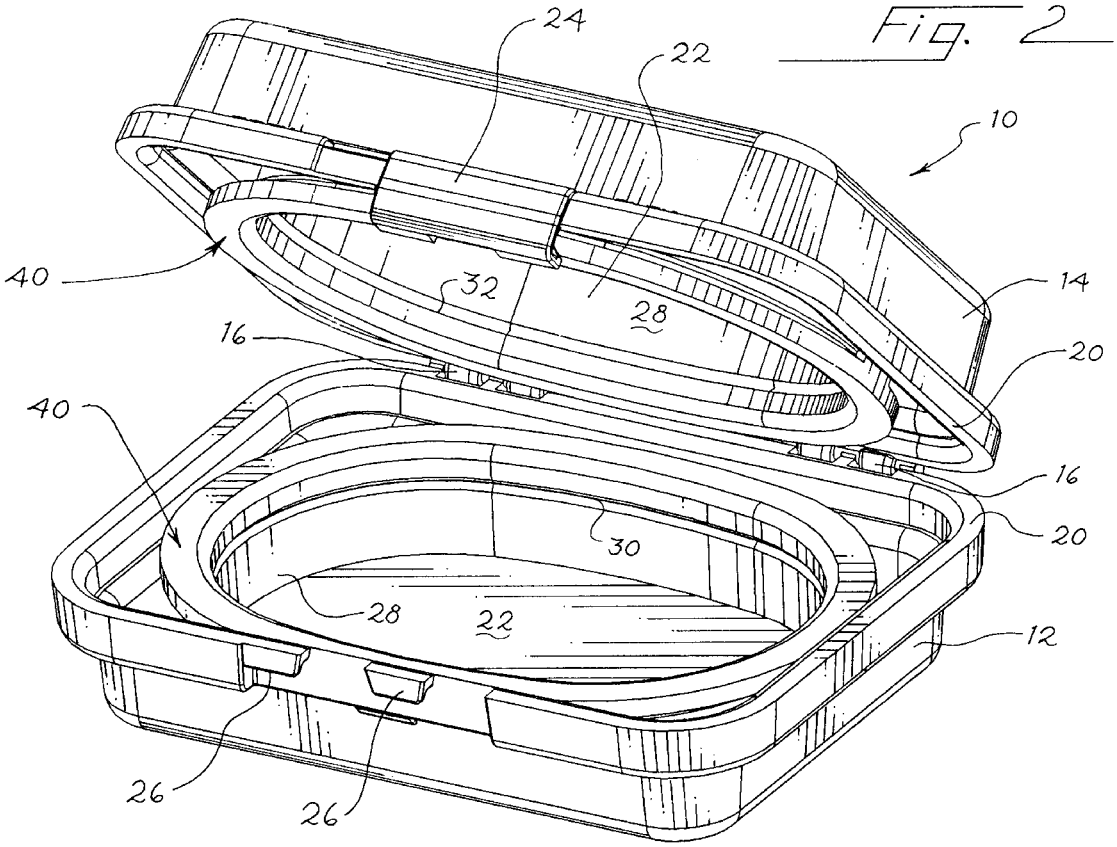
FIG. 2 is a perspective view of the packaging device of FIG. 1 in a partially opened configuration.

Turning now to FIGS. 1 and 2, these figures show perspective views of a packaging device 10 which incorporates a first presently preferred embodiment in this invention. As best shown in FIG. 2, the packaging device 10 includes a lower container portion 12 and an upper container portion 14 which are interconnected along one side by a pair of hinges 16. The hinges 16 allow the container portions 12, 14 to rotate between the fully closed position of FIG. 1 and a fully opened position (not shown) which is rotated by approximately 180° from the closed position of FIG. 1.

Each of the container portions 12, 14 defines a respective peripheral lip 20, and the peripheral lips 20 are arranged to meet one another in face-to-face contact when the packaging device 10 is fully closed, as shown in FIG. 1. The container portions 12, 14 form a rigid container to protect the object or objects being packaged.

As best shown in FIG. 2, a sliding latch 24 is mounted to the upper container portion 14. The latch 24 is configured to engage locking flanges 26 on the lower container portion 12. FIG. 2 shows the latch 24 moved to the right, where the latch 24 releases the locking flanges 26, and allows the container portions 12, 14 to hinge away from one another. FIG. 1 shows the latch 24 moved to the left, where the latch 24 engages the locking flanges 26 to hold the container portions 12, 14 in the closed position of FIG. 1. Preferably, the latch 24 and the flanges 26 are shaped such that the container-opening forces developed by the interaction of films 46 and the packaged object tend to hold the latch 24 in the closed position of FIG. 1. The latch 24 can be moved to open the container 10 by momentarily pressing the upper and lower portions 12, 14 together, thereby isolating the latch 24 from these forces.

As best shown in FIG. 2, each of the container portions 12, 14 defines a respective oval wall 28 which surrounds a respective central portion 22. Each of the walls 28 terminates in a frame support surface 30, 32.

Figure 4:
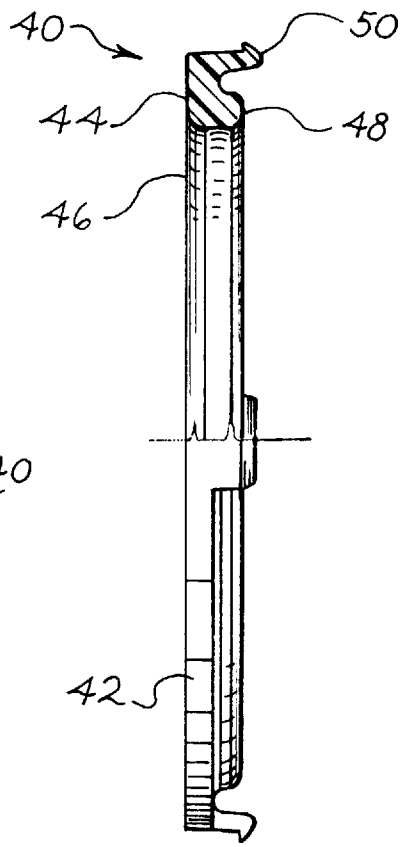
FIG. 4 is a side view in partial section of the frame of FIG 3.
Figure 3:
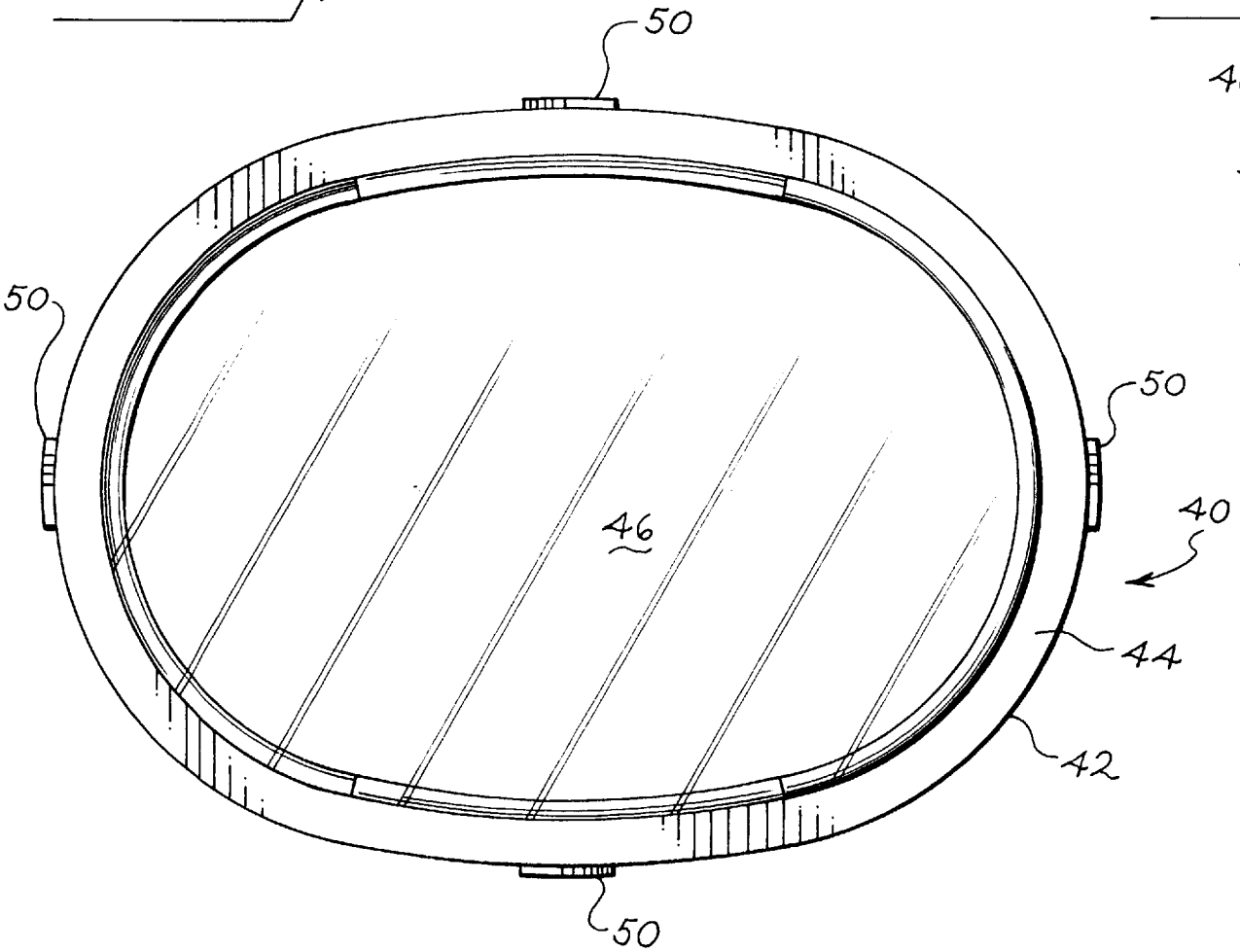
FIG. 3 is top view of a frame included in the device of FIGS. 1 and 2.

As shown in FIG. 2, a support element 40 is mounted in place adjacent the frame support surface 30, 32 of each of the container portions 12, 14. FIGS. 3 and 4 show top and side views, respectively, of one of the support elements 40. Each of the support elements 40 includes an oval frame 42 which defines an upper film support surface 44 and a lower surface 48. A film 46 is secured to the film support surface 44, such that the entire central portion bounded by the frame 42 is covered by the film 46. The lower surface 48 is shaped to cooperate with the respective frame support surface 30, 32, and each of the frames 42 includes four snap latches 50, positioned as shown in FIG. 3.

Figure 5:
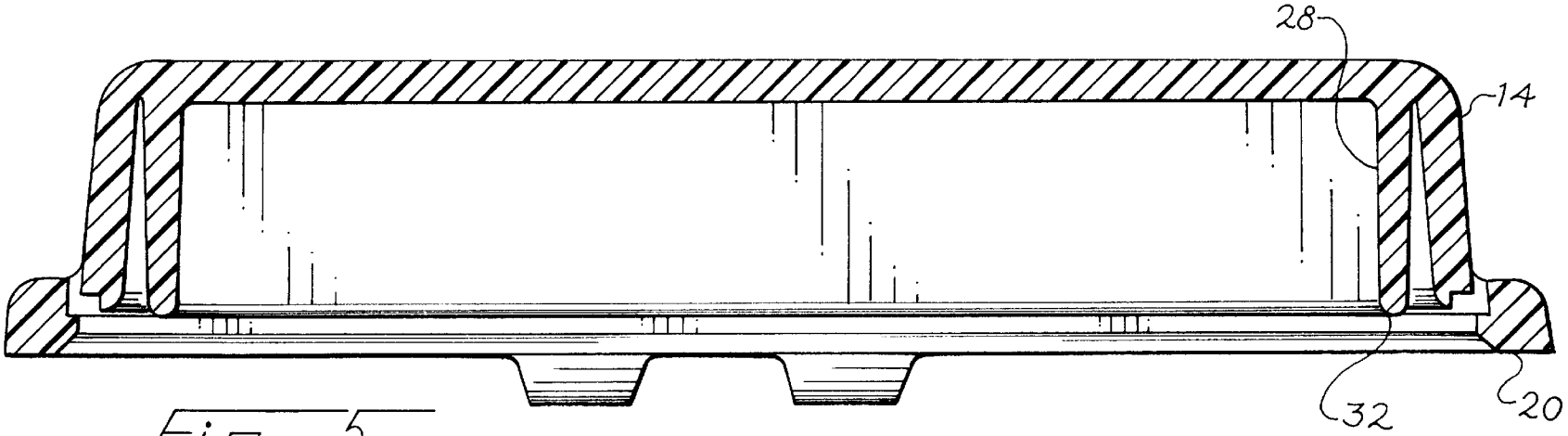
FIG. 5 is a cross-sectional view of the upper container portion of the packaging device of FIGS. 1 and 2, prior to installation of the frame.
Figure 6:
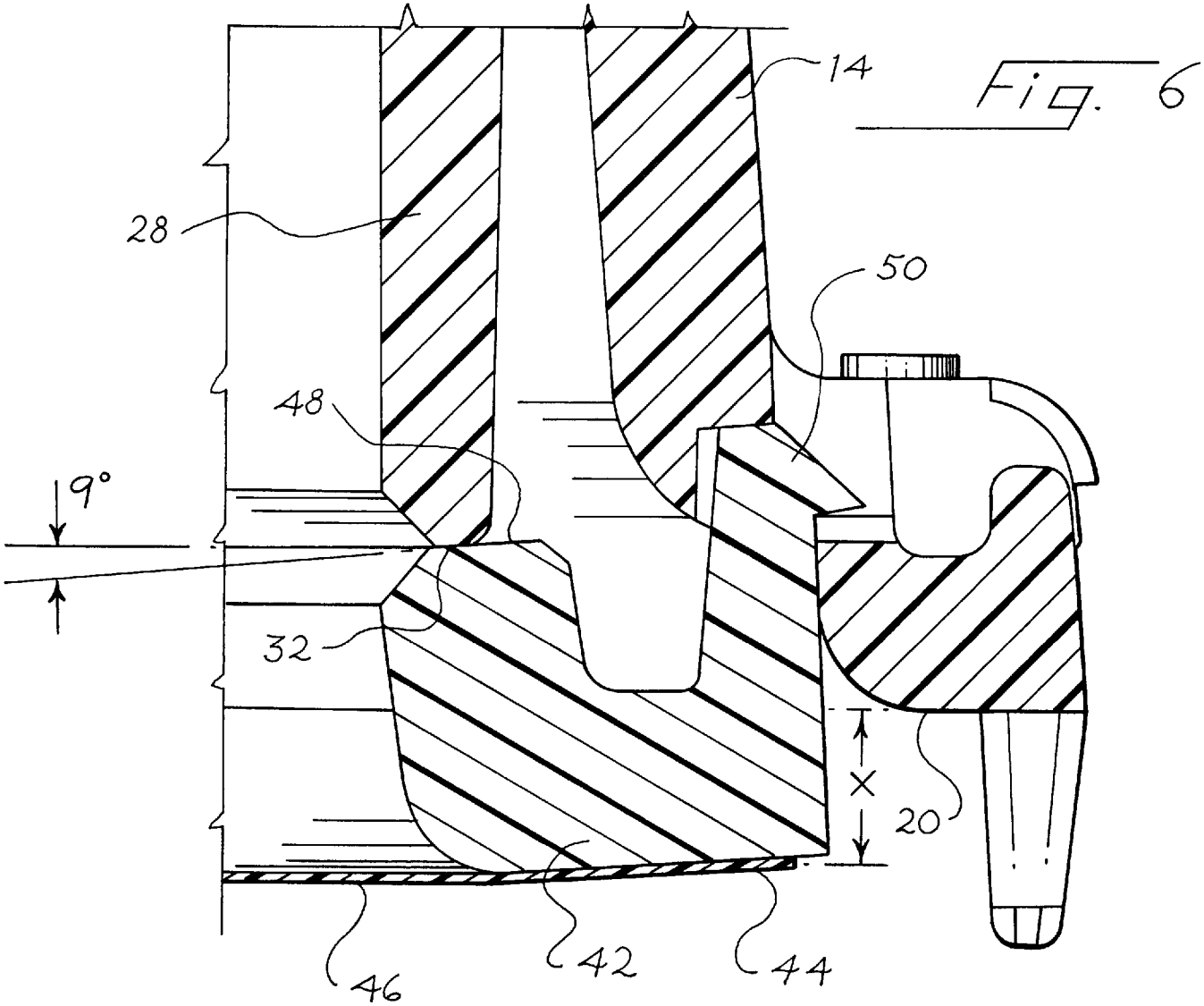
FIG. 6 is an enlarged fragmentary sectional view corresponding to a portion of the cross-section of FIG. 5, with the frame and film mounted in place.

FIG. 5 shows a cross-sectional view of the upper container portion 14. This figure clearly shows the relationship between the peripheral lip 20 and the frame support surface 32. FIG. 6 is an enlarged view of the right-hand portion of the section of FIG. 5, showing the frame 42 mounted in place. As clearly shown in FIG. 6, the frame support surface 32 is generally frusto-conical in shape, and defines a cone angle of about 9° in this embodiment. The snap latches 50 are received in respective openings in the container portion 14 such that the snap latches 50 releasible but securely hold the support element 40 in place in the container portion 14.

The packaging device 10 includes means for increasing film tension in the support element 40 automatically as the support element 40 is installed in place in the container portion 14. As will be apparent from the discussion of alternative embodiments below, the means for increasing film tension can take many forms. In this embodiment, this means takes the form of means for rotating the frame 42 outwardly so as to increase tension on the film 46. The snap latches 50 cooperate with the frusto-conical frame support surface 32 such that the entire frame 42 pivots about the frame support surface 32, counterclockwise in the view of FIG. 6, as the snap latch 50 is engaged with the container portion 14. This outward rotation of the frame 42 occurs at each of the snap latches 50, and thus at two sets of mutually opposed portions of the frame 42. This outward rotation increases tension on the film 46 such that the film 46 is more tightly tensioned after the support element 40 is installed in the container portion 14 than before.

Figure 7:
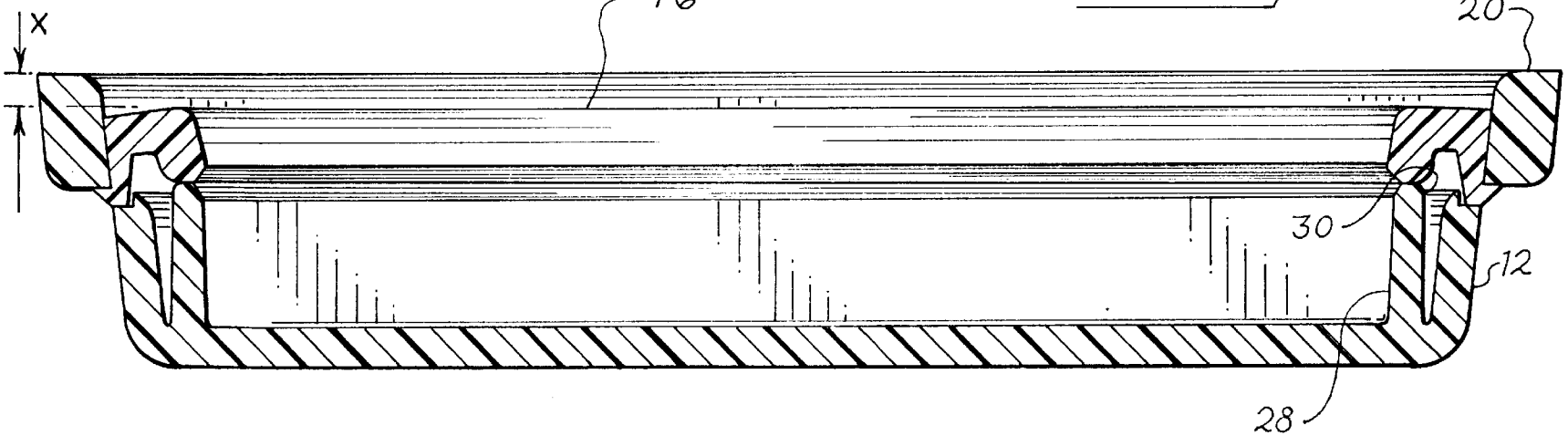
FIG. 7 is a cross-sectional view of the lower container portion of the packaging device of FIGS. 1 and 2, with the frame and film mounted in place.

FIG. 7 is a cross-sectional view of the lower container portion 12, with the respective support element 40 mounted in place. The lower container portion 12 and the support element 40 also include means for automatically increasing film tension as described above in conjunction with FIG. 6.

Note that in FIG. 6 the frame support surface 32 is positioned such that the film 46 is oriented in a plane that protrudes outwardly from the lip 20 by a selected distance X. As shown in FIG. 7, the frame support surface 30 is recessed such that the film 46 is recessed with respect to the lip 20 by a selected distance X. In this preferred embodiment, the distance X of FIG. 6 is substantially equal to the distance X of FIG. 7 such that when the peripheral lips 20 are brought into contact when the packaging device 10 is fully closed, the films 46 are substantially brought into contact. This arrangement provides the important advantage that the film 46 is recessed with respect to the peripheral lip 20 of the lower container portion 12, and the peripheral lip 20 acts as a barrier preventing the object from rolling off of the film 46. This arrangement allows an object (not shown) to be placed on the film 46 of the lower container portion 12 with substantially no risk that the object will roll off of the film 46. Because the distance by which the film 46 protrudes in the upper container portion 14 matches the distance by which the film 46 is recessed in the lower container portion 12, this advantage is obtained while still having the films 46 in face-to-face contact when the packaging device 10 is closed in the absence of a packaged object. If desired, a cushioning material may be secured to one or both films 46 to reduce any tendency of thin, wafer-like objects to move along the films 46.

FIGS. 8–13 relate to a second preferred embodiment of this invention, which relies on a different form of a means for increasing film tension. This second embodiment includes a packaging device 100 which includes lower and upper container portions 112, 114. Each of the container portions 112, 114 defines a respective peripheral lip 120, and the peripheral lips 120 are designed to meet when the packaging device 100 is closed, as shown in FIG. 13.

As best shown in FIGS. 9 and 10, each of the container portions 112, 114 defines a respective oval wall 128 which terminates at its upper end in a respective film contacting surface 164. The film contacting surface 164 for the lower container portion 112 is recessed with respect to the peripheral lip 120, while the film contacting surface 164 for the upper container portion 114 protrudes beyond the peripheral lip 120.

As best shown in FIGS. 11 and 12, two support elements 140 are provided, each comprising a respective oval frame 142 that supports a respective film 146 at a film support surface 144. Each of the frames 142 defines a plurality of snap latches 150. FIGS. 11 and 12 show the support elements 140 assembled in place on the container portions 112, 114. Note that in each case, the film support surface 144 is recessed with respect to the respective film contacting surface 164. The frames 142 are disposed radially outwardly with respect to the walls 128, and the latches 150 hold the frames 142 in position. Note that in the fully assembled position, the film contacting surfaces 164 press the film 146 out of the plane of the film support surface 144, thereby increasing film tension.

FIG. 13 shows the packaging device 10 in the closed position, with an object O suspended between the tensioned films 146.

Figures 14, 15, 16, 17, 18:
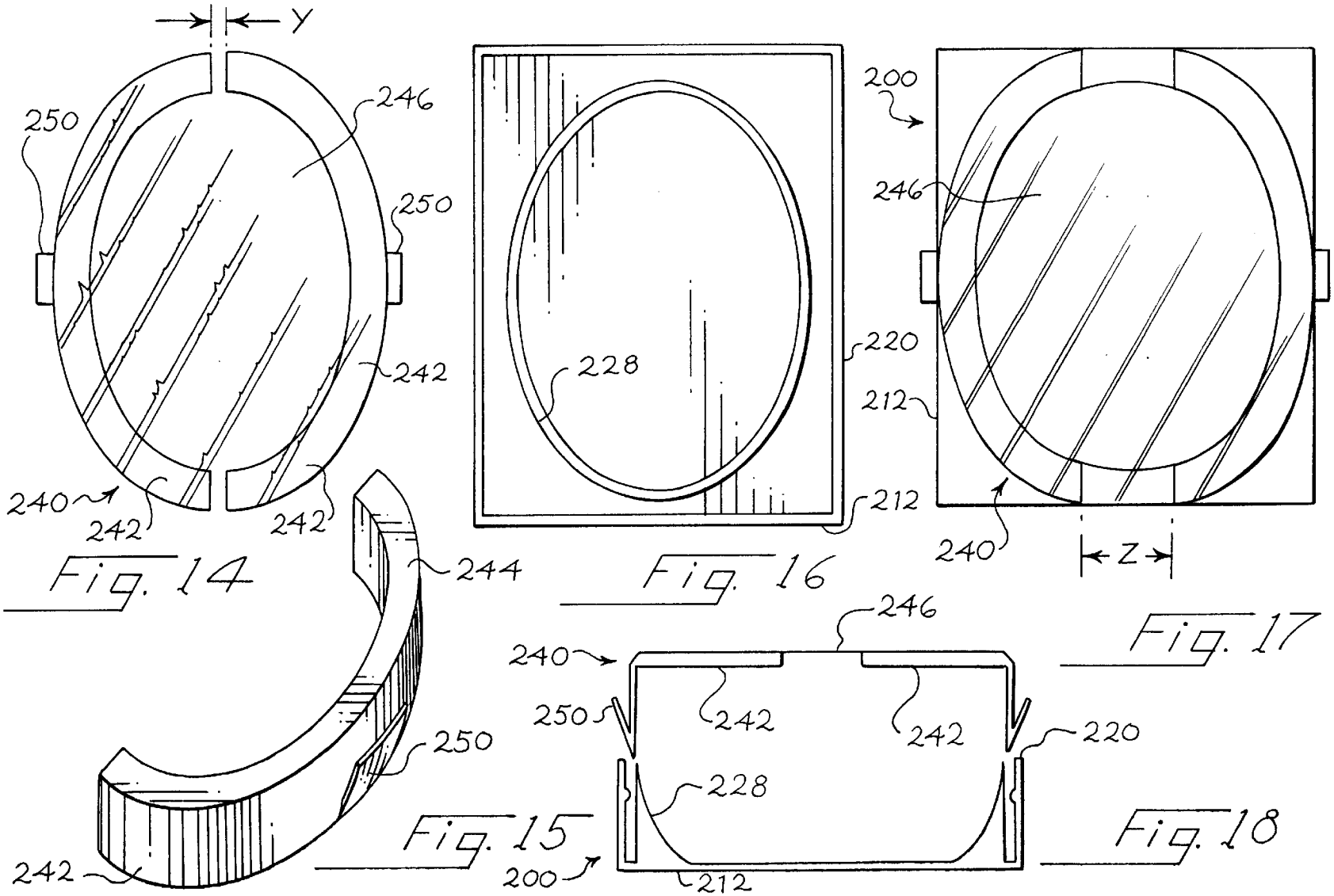
FIG. 14 is a top view of a film and frame subassembly of a third preferred embodiment of this invention.
FIG. 15 is a perspective view of one of the frames included in the subassembly of FIG. 14.
FIG. 16 is a top view of a container portion for a third embodiment of this invention which utilizes the subassembly of FIG. 14.
FIG. 17 is a top view corresponding to FIG. 16 showing the frame subassembly mounted in place.
FIG. 18 is a cross-sectional view showing the subassembly of FIG. 14 being mounted in the container portion of FIG. 16.

FIGS. 14–18 relate to a third preferred embodiment which utilizes yet another means for increasing film tension. This embodiment includes a packaging device 200 which includes upper and lower container portions designed to hinge toward and away from one another as described above. In this case only the lower container portion 212 is shown. The support element 240 includes two frames 242 which cooperate to form a generally oval shape as shown in FIG. 14. The two frames 242 may be interconnected by a flexible segment if desired. The frames 242 include snap latches 250, and they support a film 246 at a film support surface 244. When the film 246 is initially secured to the frames 242, there is a relatively smaller distance Y between opposed surfaces of the frames 242.

FIG. 16 shows a top view of the lower container portion 212 which includes an oval wall 228 inwardly positioned with respect to a peripheral lip 220.

FIG. 17 is a view corresponding to FIG. 16 showing the support element 240 mounted in place. Note that the film 246 must be stretched to allow the support element 240 to fit in place on the wall 228. This is clearly shown in FIG. 17 where the distance Z is greater than the distance Y of FIG. 14.

FIG. 18 shows the installation of the support element 240 in place in the lower container portion 212. First, the frames 242 are moved away from one another so as to increase tension on the film 246. Then the frames 242 are engaged with the lower container portion 212, with the frames 242 extending radially outwardly of the wall 228. The snap latches 250 then holds the assembly together. The snap latches 250 can be designed to hold the support element 240 permanently in place in the container portion 212. Alternately, the snap latch 250 can be made releasable, or can be entirely eliminated if it is desired to allow replacement of the support element 240.

All three of the embodiments described above provide the advantage that they allow the support element 40, 140, 240 to be preassembled by securing the film 46, 146, 246 to the frame 42, 142, 242 with the film at relatively low tension. Preferably, the film is simply secured to the support element at ambient conditions with no applied tension. This substantially simplifies assembly of the support element 40, 140, 240. Then, at the time the support element 40, 140, 240 is installed in place in the packaging device 10, 100, 200, the act of installation automatically increases tension on the film 46, 146, 246. In this way, all of the advantages of a removable support element 40, 140, 240 can be obtained, while reducing or avoiding the need for pre-tensioning the film 46, 146, 246 at the time the support element 40, 140, 240 is assembled.

Of course, it should be understood that a wide range of changes and modifications can be made to the preferred embodiments described above. For example, the snap latches can be placed on the frame or the container, or they can be entirely eliminated in some applications. The frustoconical frame support surfaces 30, 32 can be arranged conically upwardly or conically downwardly as desired. When two frames 242 are used, they may be connected as desired to facilitate assembly, as for example, with a flexible strap. Of course, more than two frames can be used if desired, and each support element 40, 140, 240 can include more than one support film if desired. The container portions may take any desired forms, and may be made of any suitable materials. The support elements 40, 140, 240 can take any desired shape, including round and rectangular.

The film tensioning means of this invention can be used with or without an offset between the face of the peripheral lip and the plane of the film. When an offset is used, it may be either equal or substantially equal on the two halves of the container as described above. In several instances in the foregoing description, distances have been defined. Of course, in each case, the term "distance" is intended to encompass a range of distances.

The film tensioning means of this invention can be used to increase film tension, whether or not the film was originally tensioned at the time the film was secured to the frame. Also, the film tensioning means can be used with packaging devices that employ a film on only one side of the packaged object. The hinge and latch between the upper and lower container portions can be modified as appropriate for the particular application, or eliminated entirely if desired.

Finally, the various aspects of this invention, though preferably used in combination as described above, are not required to be used together. For example, the film tensioning aspect of this invention can be used with a container that has no offset between the plane of the peripheral lip and the plane of the film, as shown in FIG. 18. Similarly, the offset aspect of this invention can be used without the film tensioning aspect of the invention.

Simply by way of example and in order to define the presently preferred embodiments of this invention, the following details of construction are provided. It should clearly be understood that these details can easily be varied as appropriate for the intended application. The frame 42, 142, 242 can be formed of a rigid moldable material such as polyvinyl chloride, PETG, or urethane. The film 46, 146, 246 can be formed of a resilient material such as polyurethane in a thickness such as 2–8 mils such as that supplied by J. P. Stevens as film no. 1495. The container portions 12, 14, 112, 114, 212 can be formed of any suitable moldable material such as clear ABS, K-resin, or polycarbonate. The film 46, 146, 246 can be secured to the frame 42, 142, 242 by any suitable means such as RF sealing, ultrasonic welding, a suitable adhesive, or the like.

It is intended that the foregoing detailed description be regarded as an illustration of preferred embodiments of this invention and not as a definition of the invention. It is the following claims, including all equivalents, which are intended to define the scope of this invention.

We claim:

1. A packaging device comprising:

first and second container portions;

at least one support element comprising at least one frame and a film secured to the frame, said support element secured in the first container portion with at least a central portion of the film spaced from the first container portion; and means, included in the first container portion and coupled to the support element, for increasing tension on the film when the support element is secured in place to the first container portion.

2. The invention of claim 1 wherein the tension-increasing means comprises:

means for rotating at least a portion of the frame away from an opposed portion of the frame when the support element is secured in place to the first container portion.

3. The invention of claim 1 wherein the at least one frame comprises first and second frames, and wherein the tension-increasing means comprises:

means for moving the first and second frames away from one another when the support element is secured in place to the first container portion.

4. The invention of claim 1 wherein the frame comprises a film-support surface situated in a first plane, and wherein the tension-increasing means comprises:

means for contacting the film at a film-contacting surface when the support element is secured in place to the first container portion, said film-contacting surface positioned to force the film out of the first plane and thereby to increase tension on the film.

5. A packaging device comprising:

first and second container portions, said first container portion comprising a frame-support surface and a central portion;

at least one support element comprising at least one frame and a film secured to the frame, said frame supported on the frame-support surface with the film extending over the central portion;

a frame retainer holding the frame in place in the first container portion, said frame retainer positioned to rotate the frame about the frame-support surface away from the central portion such that the frame retainer increases tension on the film when the frame retainer engages the frame and the first container portion.

6. The invention of claim 5 wherein the frame retainer comprises a snap latch.

7. The invention of claim 5 wherein the frame is generally oval in shape.

8. The invention of claim 5 wherein the frame-support surface is generally frusto-conical.

9. The invention of claim 8 wherein the frame-support surface and the frame form respective oval shapes.

10. A packaging device comprising:

first and second container portions, said first container portion comprising at least two frame-support surfaces positioned on respective sides of a central portion;

at least one support element comprising at least two frames and a film secured between the frames, said frames supported on the respective frame-support surfaces with the film extending over the central portion;

said film dimensioned to space the frames by a first distance in an absence of applied film-tensioning forces, said frame-support surfaces situated to space the frames by a second distance, greater than the first distance, and thereby to increase tension on the film when the frames are installed on the frame-support surfaces.

11. The invention of claim 10 further comprising a plurality of snap retainers, each coupled between a respective one of the frames and the first container portion to secure the support element in the first container portion.

12. The invention of claim 10 wherein the frames cooperate to form a generally oval shape.

13. A packaging device comprising:

first and second container portions, said first container portion comprising at least one frame-support surface and at least one film-contacting surface;

at least one support element comprising at least one frame and a film secured to the frame such that at least a portion of the film tends to lie in a first plane;

said frame supported by the frame-support surface and said film moved by the film-contacting surface out of the first plane such that the film-contacting surface increases tension on the film when the support element is secured to the first container portion.

14. The invention of claim 13 further comprising at least one snap retainer coupled between the frame and the first container portion to secure the support element in the first container portion.

15. The invention of claim 13 wherein the frame and the film-contacting surface form respective oval shapes, and wherein the frame is disposed radially outwardly from the film-contacting surface.

16. The invention of claim 1 or 5 or 10 or 13 wherein the packaging device comprises two of the support elements, each coupled to a respective one of the container portions.

17. The invention of claim 16 wherein each of the container portions comprises a respective lip, wherein the film associated with the first container portion is recessed below the lip of the first container portion, and wherein the film associated with the second container portion is situated above the lip of the second container portion.

* * * * *

UNITED STATES PATENT AND TRADEMARK OFFICE

CERTIFICATE OF CORRRECTION

PATENT NO. : 5,769,235
DATED : June 23, 1998
INVENTOR(S) : Priscilla M. Keach, et al.

It is certified that error appears in the above-identified patent and that said Letters Patent is hereby corrected as shown below:

Title page item [56] insert --

FOREIGN PATENT OR PUBLISHED FOREIGN PATENT APPLICATION

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 0 | 5 | 5 | 78 | 0 | 4 | A1 | 02/11/93 | EPO | | | | |
| | | 6 | 3 | 0 | 3 | 1 | 3 | | 06/25/79 | Switzerland | | | | |
| | | 1 | 4 | 2 | 5 | 7 | 4 | 6 | 02/18/76 | Great Britain | | | | |
| | | | | | | | | | | | | | | |

--.

Signed and Sealed this

Second Day of March, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,768,235
DATED : June 16, 1998
INVENTOR(S) : Huber

It is certified that error appears in the above-identified patent and that said Letters Patent is hereby corrected as shown below:

Column 7,
Line 37, delete "$X_2$=NLET 30 $\Delta$T2," and insert in place thereof -- $X_2$=NLET + $\Delta$T2, --.
Line 49, delete ", with $\Delta$T1 22 $\Delta$T2" and insert in place thereof -- , $\Delta$T1 > $\Delta$T2 --.

Signed and Sealed this

Twenty-first Day of May, 2002

*Attest:*

*Attesting Officer*

JAMES E. ROGAN
*Director of the United States Patent and Trademark Office*